US005555762A

United States Patent [19]

Kawamura et al.

[11] Patent Number: 5,555,762

[45] Date of Patent: Sep. 17, 1996

[54] METHOD OF BENDING METALLIC PIPE

[75] Inventors: Yoshiro Kawamura, Kumamoto-ken; Isao Manabe, Neyagawa; Shingo Nakashima, Osaka, all of Japan

[73] Assignees: Honda Giken Kogyo Kabushi Kaisha, Tokyo; Marubishi Yuha Kogyo Kabushiki Kaisha, Osaka, both of Japan

[21] Appl. No.: 411,301

[22] Filed: Mar. 29, 1995

Related U.S. Application Data

[63] Continuation of Ser. No. 126,204, Sep. 24, 1993, abandoned.

[30] Foreign Application Priority Data

Oct. 12, 1992 [JP] Japan ..... 4-273031
Sep. 14, 1993 [JP] Japan ..... 5-228715

[51] Int. Cl.[6] ..... B21D 9/15

[52] U.S. Cl. ..... 72/369; 72/466

[58] Field of Search ..... 72/150, 369, 466; 29/423

[56] References Cited

U.S. PATENT DOCUMENTS 3,343,250 9/1967 Berto et al. ..... 72/369
3,756,053 9/1973 Hill et al. ..... 72/369

FOREIGN PATENT DOCUMENTS 50-26753 3/1975 Japan .
50-102563 8/1975 Japan .
54-28767 3/1979 Japan .
28767 3/1979 Japan ..... 72/369
55-77935 6/1980 Japan .
56-111526 9/1981 Japan .
57-56116 4/1982 Japan .
1-122623 5/1989 Japan .
1510967 9/1989 U.S.S.R. ..... 72/369

*Primary Examiner*—Lowell A. Larson
*Attorney, Agent, or Firm*—Armstrong, Westerman, Hattori, McLeland & Naughton

[57] ABSTRACT

A filling material such as a fatty acid is filled into a metallic pipe in a molten state. The metallic pipe is then bent at a room temperature in a condition in which the filling material is solidified. After the bending work has been finished, the filling material is melted and discharged out of the pipe. The filling material may be a mixture of a fatty acid and a powdery additive.

18 Claims, 2 Drawing Sheets

METHOD OF BENDING METALLIC PIPE

This application is a continuation, of application Ser. No. 08/126,204, filed Sep. 24, 1993, now abandoned.

BACKGROUND OF THE INVENTION

1. Field of the Invention

The present invention relates to a method of bending a metallic pipe such as a square pipe, a small-diameter pipe, a multiple pipe, or the like.

2. Description of Related Art

An exhaust pipe for a motorcycle is subjected to a surface treatment to aesthetically improve the external appearance and has a double-pipe or multiple-pipe construction to prevent the surface-treated layer from deteriorating in color due to the heat of the exhaust gas.

Conventionally, in bending this kind of multiple pipe, the bending work is carried out after filling the clearance between each of the constituent metallic pipes with various kinds of filling materials including metals of low melting point, particles such as sand, or the like in order to prevent the inner and outer pipes from buckling as well as to keep the clearance between each of the constituent metallic pipes to a predetermined distance.

However, when a metal of low melting point is used as the filling material, it is difficult to discharge the metal out of the clearance after the bending work has been finished. Post-treatment is thus troublesome and, as a result, the machining or working cost becomes high. When particles such as sand are used, they are partially agglomerated, or solidified into larger lumps, due to the pressure at the time of bending and therefore are difficult to be discharged. Further, after the bending work has been finished, there will sometimes remain irregularities on the surface of the metallic pipe, thereby impairing the external appearance.

In order to cope with the above-described problems, there is used wax which is easy to be discharged after the bending work has been finished. However, there also exists a problem in that, due to insufficient hardness of the wax, the metallic pipe is likely to be flattened, or get out of roundness, or the inner pipe is likely to become eccentric relative to the outer pipe. There is also proposed a method of bending a multiple metallic pipe after freezing the water which is sealed into the clearance between the constituent metallic pipes. This method necessarily requires a large-scale equipment such as a freezing apparatus for freezing the water as well as a low-temperature working space for carrying out the bending work while maintaining the frozen condition of the water. Further, there is another problem in this method in that, under such low-temperature conditions, the bending work becomes difficult due to the low-temperature brittleness of the metal.

On the other hand, in bending a single layer metallic pipe, the pipe is prevented from being flattened, or got out of roundness, by inserting therein a core metallic member which is arranged in the form of a rosary or a string of beads. This method has a problem in that the adjustment of the core metallic member is time-consuming. Further, since the core metallic member cannot be inserted into a pipe of small diameter, there is sometimes used the above-described method of bending the metallic pipe by filling it with a filling material including metals of low melting point, particles such as sand, or the like. There also arises a similar problem as described above in that the filling material is hard to be discharged after the bending work has been finished.

In view of the above disadvantages, the present invention has an object of providing a method of bending a metallic pipe in which the bending work of the metallic pipe can be carried out at a room temperature without causing the metallic pipe to get out of roundness or causing an inner pipe in a multiple pipe to become eccentric relative to the outer pipe and in which the post-treatment can be easily done.

According to the present invention, the foregoing and other objects are attained by a method of bending a metallic pipe comprising the steps of: filling, in a molten state, a filling material comprising essentially a fatty acid into the metallic pipe; bending, at a room temperature, the metallic pipe in a condition in which the filling material is solidified; and melting and discharging the filling material.

According to another aspect of the present invention, there is provided a method of bending a metallic pipe constructed in a form of a multiple pipe having a plurality of constituent metallic pipes of different diameters, one being disposed inside the other or another, said method comprising the steps of: filling, in a molten state, a filling material comprising essentially a fatty acid into at least the clearance between the constituent metallic pipes; bending, at a room temperature, the multiple pipe in a condition in which the filling material is solidified; and melting and discharging the filling material.

Preferably, the filling material is a mixture of the fatty acid and a powdery additive, depending on the kind of metallic pipe to be bent or machining conditions. Further, the filling material may comprise essentially a composite fatty acid which is a mixture of a plurality of fatty acids. When the composite fatty acid is used, it may be a mixture in a mixing ratio preferably of from 80 : 20 by weight to 10 : 90 by weight of stearic acid and palmitic acid.

Since the fatty acid solidifies at a room temperature and has a higher hardness when solidified than that of wax or the like, it enables the metallic pipe to be bent at a room temperature by restricting the flattening, or getting out of roundness, of the metallic pipe or the eccentricity of the inner pipe relative to the outer pipe in the multiple pipe. By mixing the fatty acid with the powdery additive, the hardness at the time of solidification increases with the result that the flattening, or getting out of roundness, of the metallic pipe or the eccentricity of the inner pipe relative to the outer pipe can be minimized.

Since the fatty acid becomes molten at 40–80° C., the fatty acid can easily be discharged after the bending work has been finished and thus the post-treatment becomes easy.

The composite fatty acid which is a mixture in a mixing ratio of from 80 : 20 by weight to 10 : 90 by weight of stearic acid and palmitic acid is low in its melting point and has a high hardness when solidified. It is therefore suitable as the filling material.

BRIEF DESCRIPTION OF THE DRAWINGS

The above and other objects and the attendant advantages of the present invention will become readily apparent by reference to the following detailed description when considered with the accompanying drawings wherein.

DETAILED DESCRIPTION OF PREFERRED EMBODIMENTS

Figure 1A:
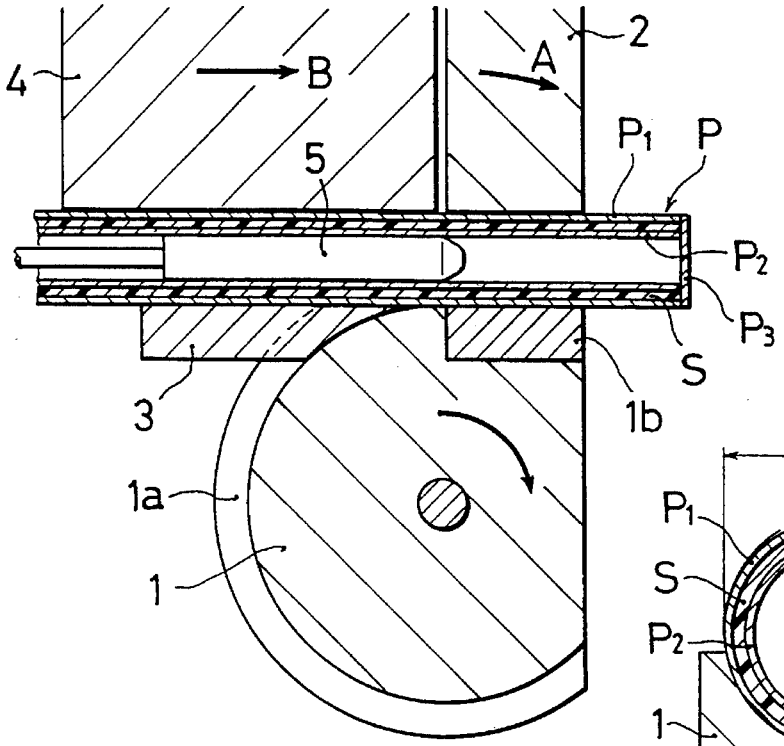
FIG. 1(*a*) and FIG. 1(*b*) are side views, partly in section, showing one example of a bending method of the present invention.
Figure 1B:
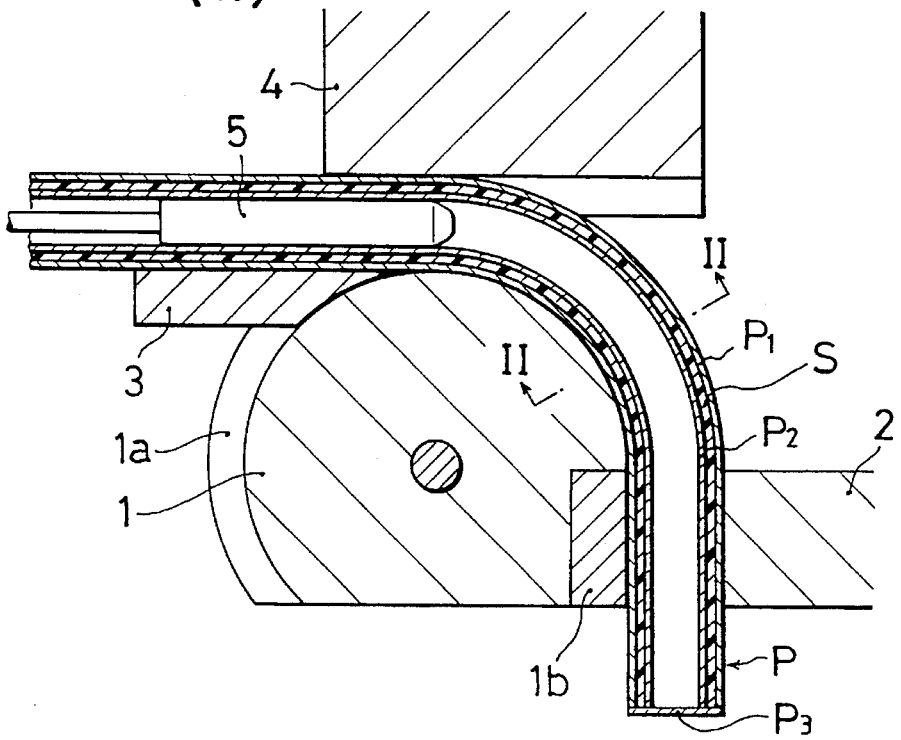

FIGS. 1(*a*) and 1(*b*) show a manner how a double metallic pipe P, in the form of a multiple pipe, made up of an outer pipe $P_1$ and an inner pipe $P_2$ is subjected to bending by a roll bending apparatus (The outer pipe $P_1$ and the inner pipe $P_2$ are called in this specification constituent pipes to make up the double pipe P).

The roll bending apparatus is made up of a roll mold 1, a clamp mold 2, a wrinkle prevention mold 3, a slide pressure mold 4, and a core metal 5. The roll mold 1 has a mold groove 1*a* which is semicircular in cross section and a clamping portion 1*b* which has another mold groove extending tangentially in continuation of the mold groove 1*a*. The clamp mold 2 rotates integrally with the roll mold 1 in the direction of an arrow A while holding an end portion of the double metallic pipe P. The wrinkle prevention mold 3 functions to prevent wrinkles or corrugations from occurring, during bending work, near a boundary portion between the bent portion and the straight portion of the double metallic pipe P. The slide pressure mold 4 is provided opposite to the wrinkle prevention mold 3 and slides in the tangential direction of the roll mold 1 as shown by an arrow B while holding the straight portion of the multiple metallic pipe P with a predetermined pressure. The core metal 5 is inserted into the double metallic pipe P so as to be positioned near the portion at which the straight portion is transformed to the bent portion, thereby preventing the portion to be bent from being subjected to distortion.

AS shown in FIG. 1(*a*), when the roll mold 1 and the clamp mold 2 are rotated in the direction A while pinching, with the clamping portion 1*b* of the roll mold 1 and the clamp mold 2, the end portion of the double metallic pipe P which is held by the wrinkle prevention mold 3 and the slide pressure mold 4, the double metallic pipe P is bent as shown In FIG. 1(*b*) while it is being pulled along the mold groove

Figure 2:
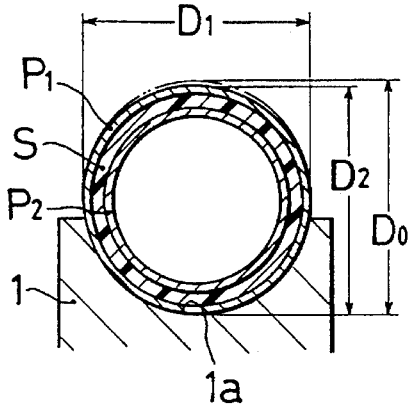
FIG. 2 is a sectional view taken along the line II—II in FIG. 1(*b*)

1*a* of the roll mold 1. At this time, since there occurs a tensile stress in the external peripheral portion of bending of the double metallic pipe P and a compressive stress in the internal peripheral portion thereof, the cross section of the bent portion will be deformed out of roundness as shown in FIG. 2.

In order to minimize this kind of deformation, a filling material S is charged, or filled, into the clearance between the outer pipe $P_1$ and the inner pipe $P_2$ of the double metallic pipe P. The following experiments were carried out using as this filling material S a fatty acid which has a melting point of 40°–80° C. and is easy of discharging after the bending work has been finished.

First, an outer pipe $P_1$ having an outside diameter of 35 mm and a thickness of 1.2 mm and an inner pipe $P_2$ having an outside diameter of 25.4 mm and a thickness of 1.2 mm were disposed concentric to each other with a clearance of 3.6 mm therebetween. Both of these pipes are carbon steel pipes for electric resistance welding for structural use in automobiles (designated as STAM290G) which is specified in Japanese Industrial Standards (JIS) G3472. One end of the pipes was sealed with a steel plate $P_3$, thereby forming a double metallic pipe P. From the other open end of the pipe, there was filled in, into the clearance between the outer pipe $P_1$ and the inner pipe $P_2$, a filling material S in the form of various kinds of heated and molten fatty acids, mixtures of various kinds of fatty acids and calcium carbonate, or the like. In a condition in which the filling material S is solidified, the double metallic pipe P was subjected to bending at a room temperature using the above-described roll bending apparatus into a bending radius of 80 mm and a bending angle of 95°. Further, for the purpose of comparison, similar experiments were carried out using paraffin, wax, and water as the filling material. The results thereof are shown in the following Table 1.

TABLE 1

| | Filling Material | | | | | Double Bent Pipe | | |
|---|---|---|---|---|---|---|---|---|
| | Composition | Melting point (°C.) | Workability | Compatibility | Penetration (25° C.) | Flatness | Clearance | Note |
| Example 1 | Stearic acid/Palmitic acid (30/70) | 54 | | | 3 | 4.5 | | |
| Example 2 | Stearic acid/Palmitic acid (65/35) | 58 | | | 9 | 8.3 | | |
| Example 3 | Behenic acid/Stearic acid (85/15) | 77 | | | 16 | 10.6 | | |
| Example 4 | Example 1/Calcium carbonate (60/40) | 56 | | | 1 | 2.9 | | |
| Example 5 | Example 2/Calcium carbonate (60/40) | 61 | | | 4 | 4.6 | | |
| Example 6 | Example 3/Calcium carbonate (60/40) | 78 | | | 2 | 3.4 | | |
| Comparative Example 1 | 145° F. paraffin* | 63 | | | 14 | 10.2 | | |
| Comparative Example 2 | Comparative example 1/Calcium carbonate (60/40) | 65 | | | 6 | — | — | |
| Comparative Example 3 | Wax* | 90 | | | 12 | 9.8 | | |
| Comparative Example 4 | Water | 0 | | | ** | 4.1 | | *** |

(See Notes)
NOTES ON TABLE 1
*Product available on the market
**Not measurable

TABLE 1-continued

| Filling Material | | | | | Double Bent Pipe | | |
|---|---|---|---|---|---|---|---|
| Composition | Melting point (°C.) | Workability | Compatibility | Penetration (25° C.) | Flatness | Clearance | Note |

***Irregularities noted on the surface of the pipe
Definition of terms are as follows:
Melting point: According to JIS K2235
Workability: Evaluation of ease with which a filling material can be filled in and discharged, depending on the melting point, flowability in molten state, or the like
Compatibility: Evaluation of degree or condition of mixing, in molten state, of a fatty acid and a powdery additive
Penetration: According to JIS K2235

$$\text{Flatness} = \frac{D_1 - D_2}{D_0} \times 100$$

wherein $D_0$ is a pipe diameter before bending, $D_1$ is a longer pipe diameter after bending, and $D_2$ is a shorter pipe diameter after bending The 145° F. paraffin in the comparative example 1 had a good flowability in a molten condition when heated but had an insufficient hardness in a solidified condition. The pipe was therefore likely to be deformed. The 145° F. paraffin having a mixture therein of a powdery additive such as calcium carbonate or the like in the comparative example 2 had an improved hardness but was poor in compatibility or mixing characteristics. Therefore, it was so readily likely to be separated that it could not be uniformly melted and filled in into the clearance. The wax in the comparative example 3, whose melting point is about 80° or below, neither had a sufficient hardness in a solidified state. If the wax has a higher melting point, it solidifies so fast at a room temperature that the charging thereof is difficult. Another disadvantage is that the wax is more expensive than the fatty acid. In the comparative example 4 using water, there is a problem, aside from the above-described disadvantages referred to in the conventional example, in that the ice was cracked at the time of bending, with the result that there occurred irregularities on the surface of the metallic pipe P.

Contrary to these comparative examples, in the embodying examples in which a fatty acid such as palmitic acid, stearic acid, behenic acid or the like were used as the filling material, though the flatness or flattening ratio was slightly inferior, the flowability when heated and melted was extremely excellent, with the result that the discharging of the filling material after the bending work was easy. In the embodying examples in which power of calcium carbonate was mixed as an additive into the above-described fatty acid in an amount of 40% by weight, the flatness was extremely as excellent as in the neighborhood of 3.5%. Though the flowability when heated and melted was slightly inferior to that when the fatty acid was singly used, it was found to be well within a commercial use.

Figure 3A:
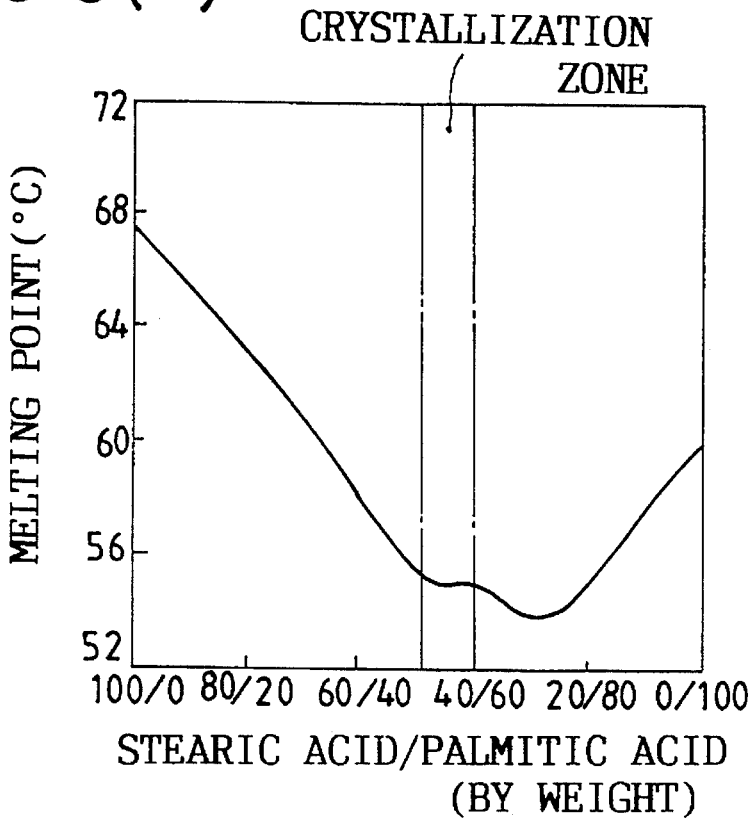
FIG. 3(*a*) and FIG. 3(*b*) are diagrams showing the changes in melting point and hardness relative to the mixing ratio by weight of stearic acid and palmitic acid.
Figure 3B:
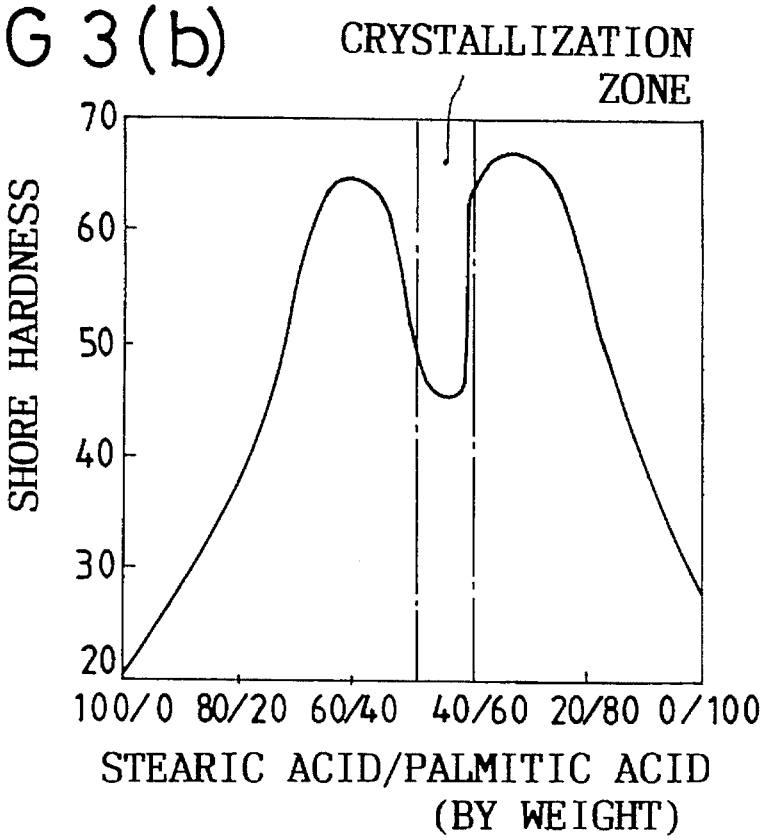

If a composite fatty acid to be prepared by mixing a plurality of fatty acids were used as the filling material as described in the above-described examples, it was possible to make the melting point of the filling material lower than when only one kind of fatty acid was used as well as to increase the hardness when solidified. For example, when stearic acid was mixed with palmitic acid, the melting point varied, as shown in FIG. 3(*a*), with the weight ratios of the stearic acid and the palmitic acid, and its hardness varied as shown in FIG. 3(*b*). Therefore, if the stearic acid and the palmitic acid are mixed in a mixing ratio of from 80 : 20 by weight through 10 : 90 by weight, an acceptable filling material having a Shore hardness of about 40 or more and a relatively low melting point can be obtained. Particularly, if the mixing ratio is selected to be 40 : 60 by weight through 20 : 80 by weight, the Shore hardness will be about 60 or more with the melting point of about 55° C. or below, resulting in a more suitable filling material. If the mixing ratio is selected to be around 60 : 40 by weight, the Shore hardness will be more than 60 with the melting point of less than 60° C., resulting in a preferable filling material for the district of hot temperature.

In the embodying examples there were shown those in which a fatty acid or a mixture of a fatty acid and a powdery additive was filled into the clearance between each of the constituent metallic pipes of the double metallic pipe. The present invention, however, is not limited to such examples. It is also applicable to a multiple metallic pipe such as a triple metallic pipe, quadruple metallic pipe, or the like.

Further, good results can also be obtained by filling the above described filling material into the metallic pipe when a single layer metallic pipe such as a square pipe, a small-diameter pipe or the like is subjected to a bending work.

As the fatty acid there can be used a saturated fatty acid such as palmitic acid, stearic acid, behenic acid, lauric acid, myristic acid, arachidonic acid or the like as well as an unsaturated fatty acid such as oleic acid, erucic acid or the like. The saturated fatty acid and the unsaturated fatty acid as described above can be used either singly or in mixture with each other. As the powdery additive there can be used powder of an inorganic matter such as calcium carbonate, talc, titanium oxide, diatomaceous earth, kaolinite, magnesium carbonate, active clay, silicon oxide, bentonite or the like as well as powder of an organic matter such as polyethylene, polypropylene, nylon, Tetron or the like. If the powdery additive is mixed with the fatty acid in excess of 50% by weight, the flowability thereof, when molten, becomes poor. Therefore, the amount of mixing the powdery additive shall be adjusted within e range of 0–50% by weight, preferably 20–45% by weight, depending on the kind of the metallic pipe and the bending conditions thereof.

As described above, according to the present invention, the bending work of a metallic pipe can be carried out at a room temperature while minimizing the flattening, or getting out of roundness, at the bent portion or the occurrence of eccentricity in the inner pipe relative to the outer pipe in the case of a multiple pipe. Therefore, a large scale equipment such as is required in bending a pipe using water in a frozen condition is not needed. Further, the post-treatment becomes easy, with the result that the working or machining cost can largely be reduced.

It is readily apparent that the above-described method of bending a metallic pipe meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A method of bending a metallic pipe which comprises:

filling the pipe with a molten filling material comprising a fatty acid;

cooling the metallic pipe and filling material to room temperature to solidify the filling material;

bending the metallic pipe filled with solidified filling material; and melting the filling material and separating it from the bent metallic pipe.

2. A method according to claim 1, wherein the fatty acid is at least one of palmitic, stearic, behenic, lauric, myristic, arachidonic, oleic or erucic acids.

3. A method according to claim 1, wherein the fatty acid is a mixture of fatty acids.

4. A method according to claim 3, wherein the mixture contains from 80:20 to 10:90 parts by weight of stearic and palmitic acids.

5. A method according to claim 4, wherein the mixture contains about 60 parts by weight of stearic acid and 40 parts by weight of palmitic acid, and has a shore hardness above 60 and a melting point below 60° C.

6. A method according to claim 1, wherein the filling material comprises a mixture of the fatty acid with a powdery additive.

7. A method according to claim 6, wherein the powdery additive is at least one of calcium carbonate, talc, titanium oxide, diatomaceous earth, kaolinite, magnesium carbonate, activated clay, silicon oxide, bentonite, polyethylene, polypropylene, nylon or polytetrafluoroethylene.

8. A method according to claim 6, wherein the mixture contains less than 50% by weight of the powdery additive.

9. A method according to claim 8, wherein the mixture contains 20–45% by weight of the powdery additive.

10. A method of bending a multiple pipe comprising a plurality of constituent metallic pipes of different diameters concentrically disposed to each other and having spaces between the constituent metallic pipes, which comprises:

filling the spaces between the constituent metallic pipes with a molten filling material comprising a fatty acid;

cooling the multiple pipe and the filling material to room temperature to solidify the filling material in the spaces between the constituent metallic pipes;

bending the multiple pipe filled with solidified filling material in the spaces between the constituent metallic pipes; and melting the filling material and separating it from the bent multiple pipe.

11. A method according to claim 10, wherein the fatty acid is at least one of palmitic, stearic, behenic, lauric, myristic, arachidonic, oleic or erucic acids.

12. A method according to claim 10, wherein the fatty acid is a mixture of fatty acids.

13. A method according to claim 12, wherein the mixture contains from 80:20 to 10:90 parts by weight of stearic and palmitic acids.

14. A method according to claim 13, wherein the mixture contains about 60 parts by weight of stearic acid and 40 parts by weight of palmitic acid, and has a shore hardness above 60 and a melting point below 60° C.

15. A method according to claim 10, wherein the filling material comprises a mixture of the fatty acid with a powdery additive.

16. A method according to claim 15, wherein the powdery additive is at least one of calcium carbonate, talc, titanium oxide, diatomaceous earth, kaolinite, magnesium carbonate, activated clay, silicon oxide, bentonite, polyethylene, polypropylene, nylon or polytetrafluoroethylene.

17. A method according to claim 15, wherein the mixture contains less than 50% by weight of the powdery additive.

18. A method according to claim 17, wherein the mixture contains 20–45% by weight of the powdery additive.

* * * * *

UNITED STATES PATENT AND TRADEMARK OFFICE

CERTIFICATE OF CORRECTION

PATENT NO. : 5,555,762
DATED : September 17, 1996
INVENTOR(S) : Kawamura et al

It is certified that error appears in the above-indentified patent and that said Letters Patent is hereby corrected as shown below:

On the title page:

Item [73] change: "Honda Giken Kogyo Kabushi Kaisha"
to: --Honda Giken Kogyo Kabushiki Kaisha--; and change: "Marubishi Yuha Kogyo Kabushiki Kaisha--
to: --Marubishi Yuka Kogyo Kabushiki Kaisha--.

Signed and Sealed this

Fourth Day of March, 1997

*Attest:*

*Attesting Officer*

BRUCE LEHMAN

*Commissioner of Patents and Trademarks*